US011410826B2

(12) United States Patent
Castellani et al.

(10) Patent No.: US 11,410,826 B2
(45) Date of Patent: Aug. 9, 2022

(54) METHOD FOR THE PRODUCTION OF A FUSE

(71) Applicant: SCHURTER AG, Lucerne (CH)

(72) Inventors: Mauro Castellani, Lucerne (CH); Peter Straub, Oberwil/Zug (CH)

(73) Assignee: SCHURTER AG, Lucerne (CH)

( * ) Notice: Subject to any disclaimer, the term of this patent is extended or adjusted under 35 U.S.C. 154(b) by 0 days.

(21) Appl. No.: 17/418,201

(22) PCT Filed: Dec. 27, 2019

(86) PCT No.: PCT/EP2019/087102
§ 371 (c)(1),
(2) Date: Jun. 24, 2021

(87) PCT Pub. No.: WO2020/136261
PCT Pub. Date: Jul. 2, 2020

(65) Prior Publication Data
US 2022/0108861 A1 Apr. 7, 2022

(51) Int. Cl.
*H01H 69/02* (2006.01)
*H01H 85/175* (2006.01)
(Continued)

(52) U.S. Cl.
CPC ..... *H01H 69/022* (2013.01); *H01H 85/0411* (2013.01); *H01H 85/06* (2013.01);
(Continued)

(58) Field of Classification Search
CPC .. H01H 69/022; H01H 85/0411; H01H 85/06; H01H 85/08; H01H 85/175; H01H 2085/0275; H01H 2085/0414
See application file for complete search history.

(56) References Cited

U.S. PATENT DOCUMENTS 2,827,532 A * 3/1958 Kozacka ..... H01H 85/10 337/160
2,833,890 A * 5/1958 Jacobs, Jr. ..... H01H 85/0456 337/228
(Continued)

FOREIGN PATENT DOCUMENTS

CN 207149513 U 3/2018
DE 1283949 B 11/1968
(Continued)

OTHER PUBLICATIONS

International Search Report and Written Opinion in PCT/EP2019/087102 dated Mar. 9, 2020, 19 pages.

*Primary Examiner* — Jacob R Crum
(74) *Attorney, Agent, or Firm* — Rothwell, Figg, Ernst & Manbeck, P.C.

(57) ABSTRACT

A method of manufacturing a fuse includes stacking a base plate, an at least partially conductive fabric over the base plate and a cover layer over the fabric, each with an intervening bonding layer. At least one cavity is provided on both sides of the fabric, adjoining the fabric, between the respective edge regions. In addition, the fabric includes at least one first fiber which is electrically conductive and second fibers which are non-conductive and which have a lower melting temperature than the first fiber. The method further includes heating the stacked elements to a temperature below the melting temperature of the first fiber and above the melting temperature of the second fibers.

22 Claims, 7 Drawing Sheets

(51) Int. Cl.
*H01H 85/041* (2006.01)
*H01H 85/08* (2006.01)
*H01H 85/06* (2006.01)
*H01H 85/02* (2006.01)

(52) U.S. Cl.
CPC ..... *H01H 85/08* (2013.01); *H01H 85/175* (2013.01); *H01H 2085/0275* (2013.01); *H01H 2085/0414* (2013.01)

(56) References Cited

U.S. PATENT DOCUMENTS 2,861,150 A * 11/1958 Swain ..... H01H 85/10 337/248
2,866,038 A * 12/1958 Kozacka ..... H01H 85/0456 337/160
2,915,609 A 12/1959 Johnston
3,020,372 A * 2/1962 Kozacka ..... H01H 85/0456 337/276
3,261,950 A * 7/1966 Kozacka ..... H01H 85/055 337/229
3,341,674 A * 9/1967 Jacobs, Jr. ..... H01H 85/055 337/276
3,425,019 A * 1/1969 Kozacka ..... H01H 85/06 337/222
3,465,275 A * 9/1969 Swain ..... H01H 85/055 337/159
4,034,328 A * 7/1977 Salzer ..... H01H 85/185 337/159
4,140,988 A * 2/1979 Oakes ..... H01H 69/022 337/279
4,179,677 A * 12/1979 Kozacka ..... H01H 85/10 337/161
4,293,836 A * 10/1981 Arikawa ..... H01H 85/046 337/290
2004/0184211 A1 9/2004 Bender et al.
2005/0206491 A1 9/2005 Aisenbrey

FOREIGN PATENT DOCUMENTS

DE 102004063035 A1 8/2005
JP H0935614 A 2/1997

* cited by examiner

METHOD FOR THE PRODUCTION OF A FUSE

CROSS REFERENCE TO RELATED APPLICATIONS

This application is a 35 U.S.C. 371 National Phase Entry Application from PCT/EP2019/087102, filed Dec. 27, 2019, which claims priority to International Application No. PCT/EP2018/0970432, filed Dec. 27, 2018, the disclosures of which are incorporated herein in their entirety by reference, and priority is claimed to each of the foregoing.

FIELD OF THE INVENTION

The present invention relates to a method of manufacturing a fuse and to a fuse manufactured by such a method, in particular a surface-mountable fuse.

BACKGROUND OF THE INVENTION

Surface-mounted device fuses (SMD) are known from the prior art as passive electrical components, which are also called chip fuses. Usually, such fuses are manufactured using printed circuit board technology. SMD fuses are usually automatically applied to FR4 printed circuit boards by pick-and-place machines and then soldered using reflow soldering processes or wave soldering. FR4 PCB materials or ceramics are mainly used as base materials for the SMD fuses. Alternatively, SMD fuses can be designed as fuses in a ceramic housing.

When manufactured by PCB-related electroplating, the FR4 PCB material consists of epoxy resin reinforced with glass fabric. Copper foils of various thicknesses (6, 9, 12, 18, 35 μm and thicker) are pressed onto the FR4 under pressure and temperature and usually form the basis for the fusible conductors. The fusible conductors themselves are structured using photolithographic methods and wet etching processes. PCB electroplating has the disadvantage that aggressive etching chemicals are required during production. In addition, it is a time-consuming and costly process in terms of time and equipment. Furthermore, the cross-sectional geometry of the fusible conductor is not exactly reproducible because the etching processes are isotropic, and the photoresist is under-etched. This has a dramatic effect on thick copper foils in particular and leads to trapezoidal instead of the desired rectangular cross-sections.

Another manufacturing method is to laminate fusible wires between circuit boards. This has the disadvantage that each wire must be fixed individually to the circuit boards. The regularity of the distances between metal wires running parallel to each other, as well as their straightness, can only be guaranteed with great effort.

Another manufacturing process is wire bonding, which originates from semiconductor manufacturing and has been transferred to PCB technology. Wire bonding originates from chip connection contacting and allows the machine connection of bond pads by means of a wire. A wire is unwound from a reel and held in contact with the respective contact pad. Subsequently, the wire and the contact pads are bonded together at least locally by a bonding process, such as thermosonic or ultrasonic methods. With such fuses, exact positioning of the wire is essential. However, the exact positioning of the wire is complex and requires additional mechanical effort.

SUMMARY OF THE INVENTION

One task of the present invention is to provide a method for manufacturing a fuse in which the disadvantages described above are avoided.

This task is solved by a method with the features of claim 1. Further embodiments of the method, as well as a fuse manufactured by such a method, are defined by the features of further claims.

A method according to an example of an embodiment of the invention for manufacturing a fuse extending from a first end along a longitudinal axis to a second end comprises the steps of:

Providing a base plate;

Stacking an at least partially conductive fabric over the base plate;

stacking a cover layer over the fabric;

providing a bonding layer, between the base plate and the fabric and between the fabric and the cover layer, at least in the respective edge regions;

wherein at least one cavity is provided on both sides of the fabric, adjoining the fabric, between the respective edge regions, wherein the fabric comprises at least one first fiber which is electrically conductive and which extends along the longitudinal axis from the first end of the fuse to the second end of the fuse and second fibers which are non-conductive and which extend at least transversely to the longitudinal axis, wherein the at least one first fiber having a higher melting temperature than the second fibers, heating the stacked elements to a temperature which is below the melting temperature of the at least one first fiber and which is above the melting temperature of the second fibers;

maintaining this temperature for a period of time;

Whereby the second fibers melt at least in the region of the at least one first fiber, whereby the at least one first fiber is released in the region of the cavities, at least partially;

cooling the stacked elements to room temperature.

With such a method, a wire-in-air fuse can be produced. Due to the at least partially electrically conductive fabric, the positions of the individual fibers of the fabric and the position of the fabric fibers in relation to each other can be determined very precisely, whereby a time-consuming positioning of the at least one fusible wire can be avoided. Likewise, the number and distribution of the fabric fibers are easily adjustable. Accordingly, the current-time behaviour, the temperature behaviour, the pulse strength, the breaking capacity, the insulation strength and the $i^2t$ values can be easily adjusted. Such a fuse also requires low material and manufacturing costs. The costs for partially electrically conductive fabric are low and the fuse can be manufactured using simple processes, for example batch processes such as those used to manufacture printed circuit boards. Other low-cost process steps, such as lamination with prepregs or hot pressing, can also be adopted from PCB production. For example, the first fibers are made of copper and the second fibers are made of a polyester. Copper has a melting temperature of about 1000° C. and polymers usually have melting temperatures of about 100° C. to 400° C.

In the case of laminated fuses, before the second fibers are melted, the casing of the fuse is produced by:

pressing the stacked elements in a direction substantially perpendicular to the base plate;

heating the stacked elements to a temperature which is below the melting temperature of the at least one first fiber and the second fibers;

maintaining this temperature for a period of time;

For example, it is heated to a temperature of 190° C. and it is maintained for one hour. This ensures that at least the edge areas of the stacked elements are firmly bonded together. The stacked elements are then heated to a temperature which is below the melting temperature of the first fibers and above the melting temperature of the second fibers. This temperature is then maintained for a period of time. In a process using first copper fibers and second polyester fibers, the stacked elements of the fusible link are heated from room temperature to a temperature of 250° C. within 3 minutes. This temperature is maintained for 90 seconds. Subsequently, the fuse is cooled down to room temperature. The fuse can also be heated to a temperature above 250° C., for example 300° C., 350° C., 400° C. or 450° C.

The holding time may be more than 90 seconds, for example 120 seconds or 180 seconds or up to 900 seconds. For second fibers made of a polymer material with a lower melting temperature, the heating time can be selected lower and the holding time shorter. The heating temperature should in any case be selected below the decomposition temperature of the material of the second fibers. The heating temperature should also be below the melting temperature or decomposition temperature of the base plate, the bonding layers and the top layer. Due to the entropy elasticity of the second fibers, in the area of the at least one first fiber, they are drawn towards the edge areas after melting. The longer the heating temperature is maintained, the more completely the second fibers are melted in the region of the at least one first fiber in the region of the cavities. The heating, or melting, of the second fibers allows the thickness of the fabric, or melted fabric, to decrease in the edge regions until they are completely filled. The bonding layers may be formed as separate layers or they may be at least partially integrated into the elements of the fuse to be bonded. For example, the base plate and/or the fabric and/or the cover layer may comprise a bonding material. For example, an adhesive lacquer or film may be used to bond two adjacent layers of the fuse together. Heating may decrease the thickness of the bonding layers. For example, part of the bonding layer may penetrate into the fabric or may swell out of the edge regions. This method can be used not only in connection with laminated fuses. It can also be used for fuses with prefabricated housing parts. For example, a fabric with first and second fibers can be bonded between two plastic housing parts. In this case, a first housing part corresponds to a base plate with a recess formed therein and a second housing part corresponds to a cover layer with a recess formed therein and the adhesive corresponds to the bonding layer.

In one embodiment, the base plate comprises a printed circuit board. For example, an FR4 or FR5 circuit board. Printed circuit boards may comprise a composite material, such as glass fiber reinforced epoxy resin. Alternatively, ceramic materials may be used, such as glass plates or ceramic plates, or combinations of plastic and ceramic may be used. Instead of epoxy resin, double-sided adhesive polyimide films can be used as a bonding layer.

In one embodiment, electrical contact elements are provided at both ends of the fuse, which are electrically conductively connected to the at least one first fiber. Such electrical contacts are also called terminals or end external contacts and are usually refined with an ENIG process, i.e., they comprise a top layer of gold.

In one embodiment, the contact elements extend over the entire surface of the two ends of the fuse. Alternatively, the contact elements may only be provided in the area of the fabric of the two end faces of the fuse. It is also possible that the contact elements partially enclose the fuse laterally and/or above and below. In such an embodiment, the contact elements are designed in the form of clips or sleeves.

In one embodiment, at least one first cavity is formed in the base plate, between the edge regions of the base plate, and at least one second cavity is formed in the cover layer, between the edge regions of the cover layer. For example, several cavities can be formed in the base plate and/or the cover layer. The individual cavities may be separated from each other by webs. The cavities may have different dimensions, i.e., they may be formed with different widths or depths. It is also conceivable that the individual cavities do not have constant dimensions, i.e., that their dimensions change along the longitudinal axis and/or transversely thereto. Depending on the size of the fuse, the edge areas are of different sizes. For example, the width of the edge areas and the webs is between 0.3 millimetres and 10 millimetres. The width of the edge areas can be larger, the same size or smaller than that of the webs.

In one embodiment, at least one frame-shaped spacer is arranged between the base plate and the fabric and/or between the fabric and the cover layer, wherein at least one third cavity is formed between the edge regions of the spacer. Thus, a third cavity is formed between the base plate and the fabric and/or between the fabric and the cover layer within the spacers. The spacer can be connected to the adjacent layers by means of bonding layers. Again, an adhesive lacquer or an adhesive film can be used here. The spacer and/or the adjacent layers can also be impregnated with an adhesive lacquer.

In one embodiment, an extinguishing layer is arranged on one or both sides of the fabric by means of a connecting layer in the corresponding cavity. The corresponding extinguishing layers may be arranged in an area close to the fabric or they may be arranged in an area remote therefrom. For example, the extinguishing layer comprises extinguishing silicone or inorganic materials having a melting point higher than that of the second fibers, for example vermiculite, PDMS or the like. The extinguishing layer may be in the form of a fabric or a film.

Alternatively, the fabric may comprise an extinguishing material. For example, when glass fibers are interwoven in the fabric. It is also possible to impregnate the fabric with silicone resin, whereby the fibers of the fabric are surrounded by a matrix of extinguishing silicone resin.

In one embodiment, the base plate, the cover layer and each of the extinguishing layers are formed as closed surfaces. That is, they extend substantially without gaps over the entire length and width of the fuse. In one embodiment, the interconnecting layers comprise a closed circumferential frame, i.e., they comprise at least one through opening spaced from the edge regions. If the fuse layers are directly connected to the base plate or the cover layer by a connecting layer, the corresponding connecting layers may be frame-shaped, strip-shaped or formed as closed surfaces.

In one embodiment, the connecting layers comprise at least one web extending transversely to the longitudinal axis from one side of the frame to an opposite side of the frame, and the at least one spacer comprises at least one web extending transversely to the longitudinal axis from one side of the frame to an opposite side of the frame. Two or more webs may also be provided, which extend from one side of the frame to a side of the frame opposite thereto. In the case of one web, there are thus two through openings in the connecting layer and/or in the spacer. Thus, two cavities adjacent thereto are created on one side of the fabric. Accordingly, there is one more cavity than there are webs.

In one embodiment, the base plate, the at least one connecting layer, the at least one fabric, the at least one spacer and the at least one cover layer are substantially rectangular in shape, i.e., they comprise a substantially rectangular ground plan and comprise two opposite ends and two opposite sides. The ends are oriented along the longitudinal axis and the sides are oriented transverse to the longitudinal axis. The corners between the ends and the sides may be rounded. The through openings of the connecting layers and the spacers may also have rounded corners. The through openings can also be shaped as slots with rounded ends.

In one embodiment, the fabric is flat. Alternatively, the fabric is pleated and comprises a plurality of permanent folds, i.e., it is folded or corrugated and comprises sections which protrude from the plane of the fabric, i.e., from the plane of connection, between the two ends of the fabric.

In one embodiment, two or more fabrics are arranged in the fuse, wherein an intermediate layer is arranged between two adjacent fabrics, which is connected to the fabrics by connecting layers or which is connected to the fabrics by connecting layers and spacers.

In one embodiment, at least a fourth cavity is formed in the intermediate layer, between the edge regions of the intermediate layer. The intermediate layers can comprise the same material as the base plate or the top layer.

In one embodiment, the fabric comprises first fibers extending transversely to the longitudinal axis. That is, the fabric comprises electrically conductive fibers extending along the longitudinal axis and electrically conductive fibers extending transversely to the longitudinal axis. The fabric may be woven such that the longitudinal fibers contact the transverse fibers and a current transmitting contact is formed.

In one embodiment, the fabric comprises second fibers extending along the longitudinal axis. That is, the fabric comprises electrically non-conductive fibers extending transversely to the longitudinal axis and electrically non-conductive fibers extending along the longitudinal axis.

In one embodiment, several first fibers are at least partially combined, i.e., several first fibers form fiber bundles which are woven together. Alternatively or additionally, several second fibers are at least partially combined. Accordingly, it is possible to weave individual conductive or non-conductive fibers together to form a fabric, or individual fibers can be woven together with fiber bundles to form a fabric, or fiber bundles can be woven together. For example, a fiber bundle may comprise a plurality of fibers fused together and arranged parallel to each other. Such a fiber bundle behaves similarly to a single fiber with a larger diameter.

In one embodiment, the fabric comprises only second fibers at least in the area of its two sides. I.e., the fabric is electrically non-conductive in the area of the two sides.

In one embodiment, the first fibers and/or the second fibers have different diameters. For example, the diameters of the conductive fibers are smaller than those of the non-conductive fibers. Alternatively, the conductive fibers may comprise a larger diameter than the non-conductive fibers.

It is also possible to provide in the fabric non-conductive fibers having a first diameter and non-conductive fibers having a second diameter different from the first diameter. For example, the conductive fibers comprise a diameter of 5 to 2,000 micrometres. The cross-sections of the first and/or second fibers may be circular, oval or polygonal.

In one embodiment, the first fibers comprise a fully conductive cross-section. Such fibers may comprise only one material or they may comprise a conductive core of a first material and a conductive coating of a second material. Alternatively, the first fibers comprise a conductive coating or a conductive core.

In one embodiment, at least one electrically conductive first fiber is wound helically around a non-conductive second fiber or around a bundle of non-conductive fibers. The winding may be uniform, i.e., the spacing of the turns is uniformly distributed over the entire length of the fabric. Alternatively, the conductive fibers can be wound locally tighter around the non-conductive fibers, i.e., with reduced winding distances. In the area of the tighter winding, the conductive fibers heat up faster, causing the fibers in this section to melt first. The area of the tighter windings thus forms a target melting point.

In one embodiment, the second fibers of a fabric may comprise different materials. For example, some fibers may comprise a material that melts when heated and some fibers may comprise a material that does not melt when heated. For example, longitudinally directed second fibers may not melt and transversely directed second fibers may melt. Some transversely directed fibers may also be non-melting, thereby ensuring positioning of the at least one first fiber centrally within the cavities. That is, the at least one first fiber may be held with the second fibers in a plane defined by the median plane of the fabric.

In one embodiment, the electrically non-conductive fibers comprise a material selected from the group comprising silicone (e.g., PDMS), Polyimide, Polyester, Polyamide (Nylon), Aramid (Kevlar), Polytetrafluoroethylene (Teflon), Polyethyleneterephthalate (PET), Ethylene-Tetrafluoroethylene-Copolymer (ETFE), Polybenzimidazole (PBI), Polyacrylonitrile (PAN), Oxidized polyacrylonitrile (Pyron), Polycarbonate (PC), polyphenylene sulfide (PPS), aromatic polyesters (e.g. Vectran), polyethylene naphthalate (PEN), polyetheretherketone (PEEK), polybutylene terephthalate (PBT), polyvinylidene difluoride (PVDF) and polypropylene (PP).

In one embodiment, the fabric comprises non-conductive third fibers interwoven with the at least one first fiber and the second fibers. The third fibers have a higher melting point than the second fibers. The third fibers may comprise basically the same material as the second fibers. Preferably, the third fibers comprise a material selected from the group comprising glass fibers, polyimide (Kapton), aramid (Kevlar), polybenzimidazole (PBI) and inorganic fibers or more precisely ceramic fibers (e.g., alumina-silicate or alumina-borosilicate).

In one embodiment, the extinguishing layer and/or the base plate and/or the cover layer and/or the conductive and non-conductive fibers comprise a mineral-coated surface, for example with a vermiculite coating.

In one embodiment, conductive and/or non-conductive fibers may be provided with surface coatings, wherein the surface coatings may be applied by PVD/CVD processes or by plasma polymerisation. Alternative coating processes for surface metallisation of non-conductive fiber cores include immersion in colloid solution and electroless deposition. The surface coating protects the underlying fiber, for example from mechanical and/or electrical and/or chemical influences.

In one embodiment, the conductive fibers may be coated with an extinguishing material.

In one embodiment, the surface coating comprises a material selected from the group comprising polyurethane (PU), polyethylene terephthalate (PET), polyamide (PA) and imides, such as polyimide (PI) or composite materials, such as copolymers or derivatives of the above materials.

In one embodiment, the electrically conductive fibers comprise a material selected from the group comprising gold, copper, silver, tin and alloys thereof. The fibers may consist entirely of this material or may comprise a conductive core or coating. The coating may be partial or complete. For example, aramid fibers may be coated with gold or nylon fibers may be coated with copper. For example, copper wires may also be partially or completely coated with tin or silver.

In one embodiment, several fuses are laminated together and then separated from each other. In this case, the individual layers have the dimensions of several fuses. For example, several base sheets assembled in one direction may form a long strip or may form a larger sheet when assembled in two mutually perpendicular directions. The fabric ensures that the conductive fibers are located in predetermined areas. Accordingly, the individual fuses may be separated in a first step only in the region of the conductive fibers, for example by a hole or a cut-out, and may be completely separated in a second step.

Alternatively, the individual fuses can be separated from each other in one step, for example by cutting, milling or sawing.

The mentioned embodiments of the fuse can be used in any combination as long as they do not contradict each other.

BRIEF DESCRIPTION OF THE DRAWINGS

Examples of embodiments of the present invention are explained in more detail below with reference to figures. These are for explanatory purposes only and are not to be construed restrictively. In the drawings.

DETAILED DESCRIPTION OF THE EMBODIMENTS

Figure 1:
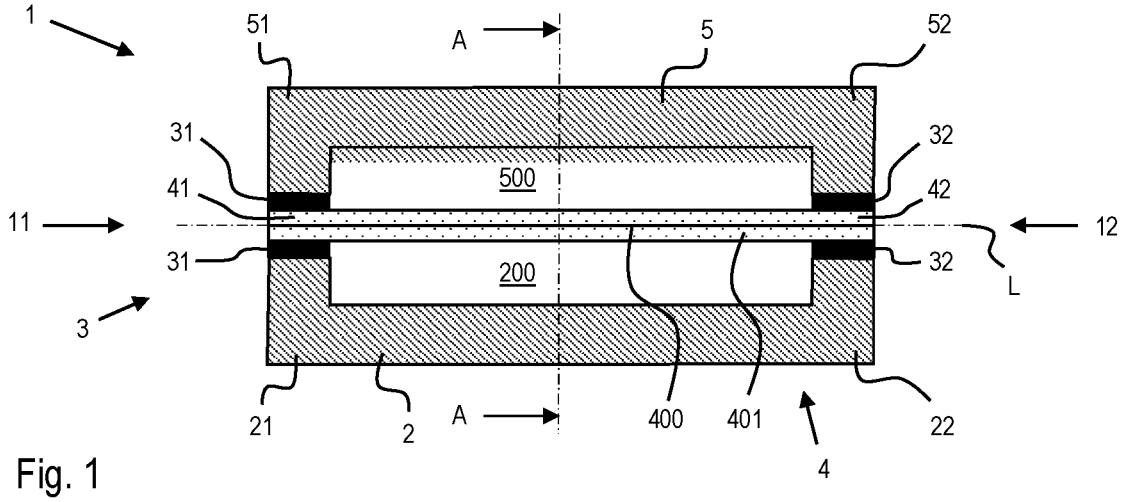
FIG. 1 a sectional view of a first embodiment of a fuse according to the invention before heating.
Figure 2:
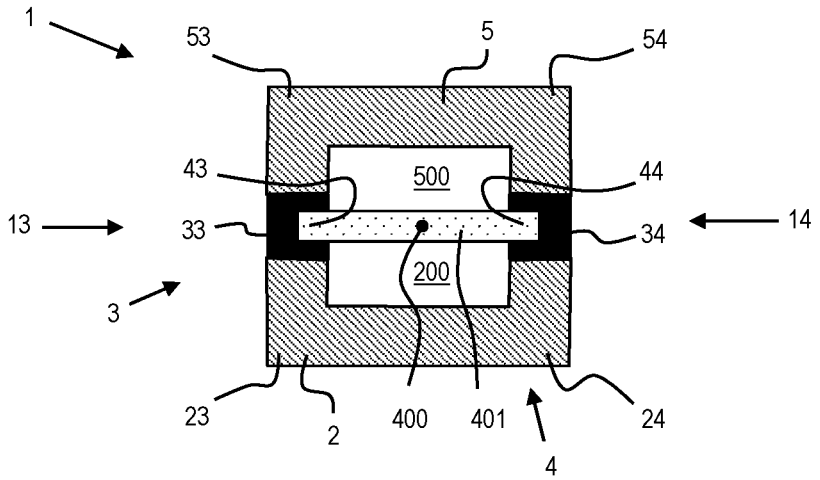
FIG. 2 a sectional view of the fuse of FIG. 1 along the section A-A of FIG. 1.
Figure 3:
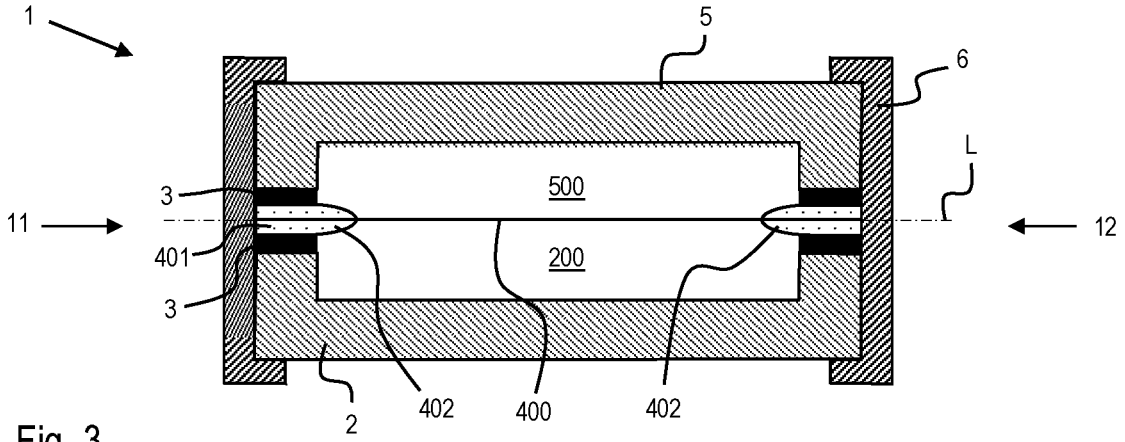
FIG. 3 a sectional view of the finished fuse of FIG. 1.
Figure 12:
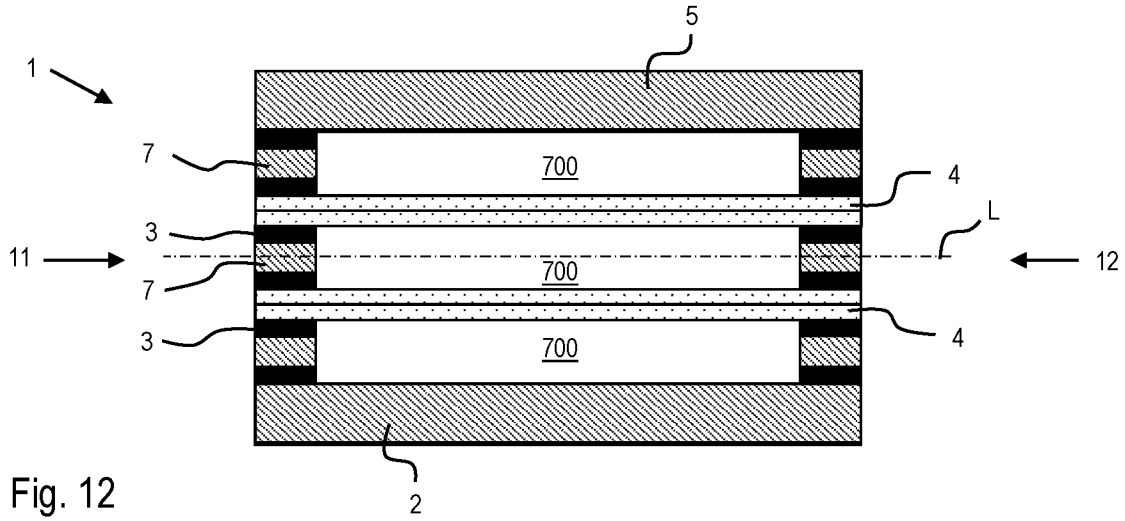
FIG. 12 a sectional view of an eighth embodiment of a fuse according to the invention before heating.

FIG. 1 shows a sectional view of a first embodiment of a fuse 1 according to the invention before heating. FIG. 2 shows a sectional view of the fuse of FIG. 1 along the line of intersection A-A and FIG. 3 shows a sectional view of the finished fuse of FIG. 1. The fuse extends along a longitudinal axis L from a first end 11 to a second end 12 opposite thereto. A base plate 2 was placed on a substantially flat base not shown here. A bonding layer 3, an at least partially conductive fabric 4, a further bonding layer or connecting layer 3 and a cover layer were stacked successively in alignment with each other thereover. The base plate 2 is a substantially rectangular printed circuit board and comprises a first end 21, a second end 22 opposite thereto, a first side 23 arranged transversely thereto and a second side 24 opposite thereto. A recess is formed in the base plate 2 at a distance from the edge regions of the upper surface of the base plate 2, which recess defines a first cavity 200 in the assembled state. The cover layer 5 is geometrically identical to the base plate 2 and comprises a printed circuit board having a first end 51, a second end 52, a first side 53, a second side 54 and a second recess which, when assembled, defines a second cavity 500. The connector layers 3 are frame-shaped and comprise a first end 31, a second end 32, a first side 33, a second side 34, as shown in FIG. 12. Unlike the connecting element of FIG. 12, the connecting element of the embodiment shown in FIGS. 1 to 3 does not comprise a central web extending between the two sides. Accordingly, only one through opening is formed at a distance from the edge regions. The at least partially conductive fabric 4 comprises a closed surface having a first end 41, a second end 42 opposite thereto, a first side 43 and a second side 44 opposite thereto. The fabric 4 comprises at least one electrically conductive first fiber 400 extending at least in the longitudinal direction from the first end 11 to the second end 12 of the fuse 1, and it comprises non-conductive second fibers 401 extending at least transversely to the longitudinal axis L. The first fibers 400 have a higher melting temperature than the second fibers 401. As can be seen in FIG. 2, the fabric 4 does not extend to the lateral outer contours of the fuse 1, whereby the fabric 4 is covered laterally outwardly by the material of the interconnection layer 3. Alternatively, the fabric 4 may extend laterally to the periphery of the fuse. Heating the stack shown in FIGS. 1 and 2 to a temperature higher than the melting temperature of the second fibers causes them to melt, thereby releasing the at least one first fiber 400, as shown in FIG. 3. Contact elements 6 are arranged at both ends 11, 12 of the fuse 1, which extend over the entire respective end surface and which are electrically conductively connected to the at least one first fiber 400.

Figure 4:
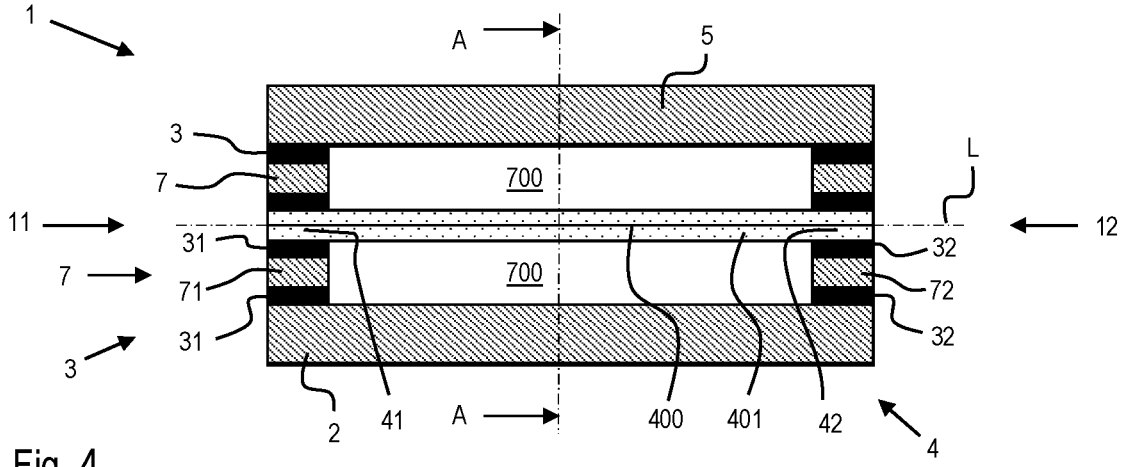
FIG. 4 a sectional view of a second embodiment of a fuse according to the invention before heating.
Figure 5:
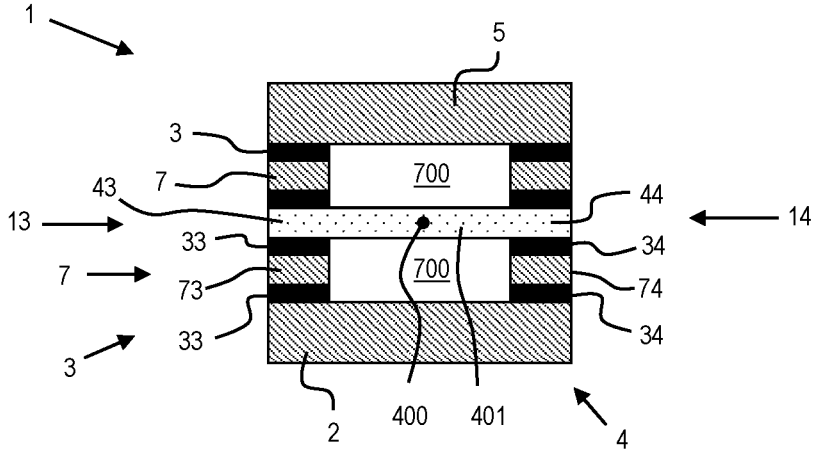
FIG. 5 a sectional view of the fuse of FIG. 4 along section A-A of FIG. 4.
Figure 6:
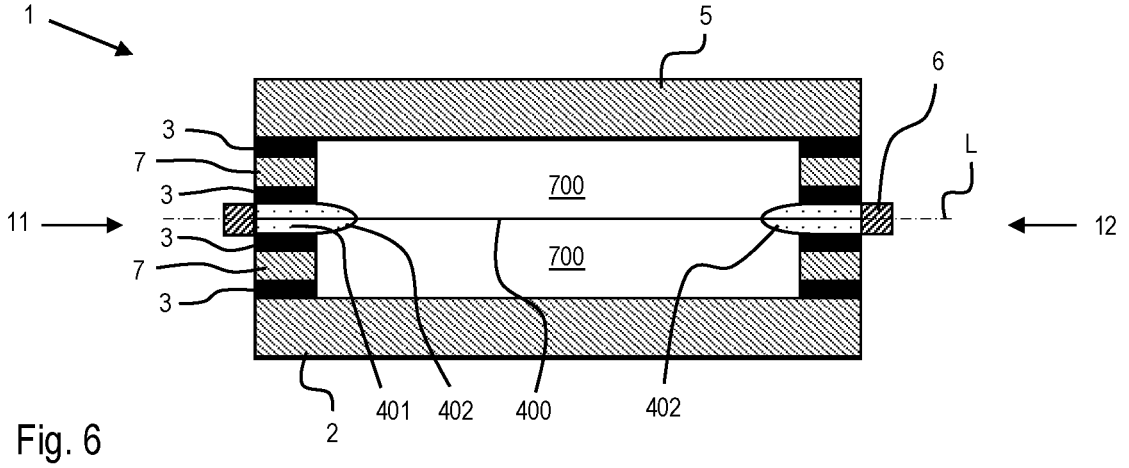
FIG. 6 a sectional view of the finished fuse of FIG. 4.

FIGS. 4 to 6 show a second embodiment of a fuse according to the invention, before and after heating. In contrast to the first embodiment, the base plate 2 and the cover layer 5 do not comprise any recesses. Instead, frame-shaped spacers 7 are provided, the interior of which delimit third cavities 700 in the assembled state. Before heating, a printed circuit board 2, a connecting layer 3, a spacer 7, a further connecting layer 3, an at least partially conductive fabric 4, a further connecting layer 3, a spacer 7, a further connecting layer 3 and a cover layer 5 are thus stacked on top of each other. The fabric 4 extends to the two sides 13,14 of the fuse 1, but the two lateral regions 43,44 of the fabric 4 are electrically non-conductive. Such a fabric 4 is shown, for example, in FIGS. 13*a* and 13*f*. Contact elements 6 are arranged at the two ends 11, 12 of the fuse 1, which extend over the area of the respective end face which contains the fabric 4.

These contact elements 6 are also electrically conductively connected to the at least one first fiber 400.

Figure 7:
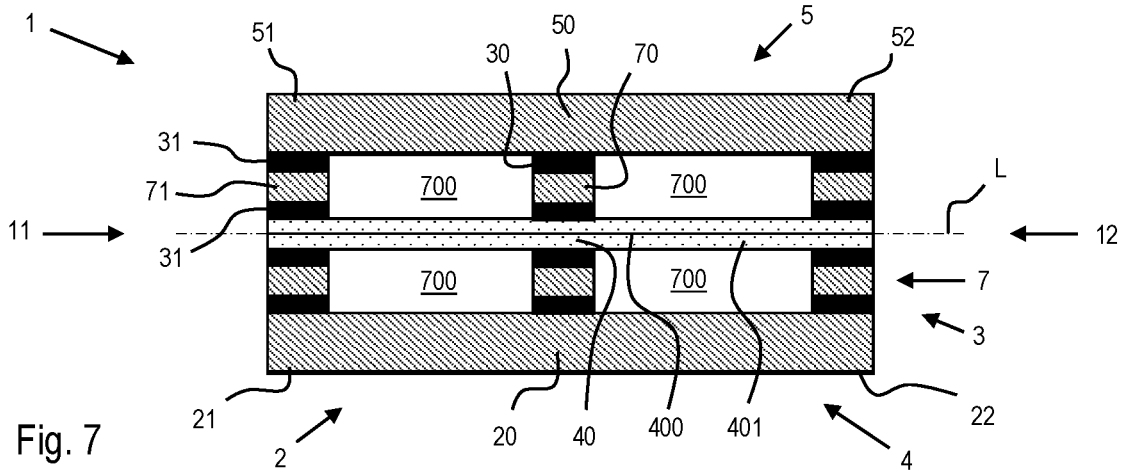
FIG. 7 a sectional view of a third embodiment of a fuse according to the invention before heating.

FIG. 7 shows a sectional view of a third embodiment of a fuse 1 according to the invention before heating. In contrast to the embodiment of FIGS. 4 to 6, the connecting layers 3 and the spacers 7 are frame-shaped and have a web (30;70). Accordingly, not only are the edge regions of the individual layers connected to each other, but a central region 20 of the base plate 2, a web 70 of the spacer 7, a central region 40 of the fabric 4 and a central region 50 of the cover layer 5 are connected to each other by webs 30 of the corresponding connecting layer 3. The connecting layer 3 extends along the longitudinal axis L from a first end 31 to a second end 32 opposite thereto and comprises a closed circumferential frame with two frame parts 31,32 near the end and two lateral frame parts 33,34, as shown for example in FIG. 12. A web 30 extends from the centre of the lateral first frame part 33 through a central region of the interconnection layer 3 to a lateral second frame part 34 opposite thereto.

Accordingly, the base plate 2 is only partially connected to the fabric 4, i.e., in the region of the frame parts of the interconnection layer 3. Accordingly, a first end 21, a second end 22, a first side, a second side and a central region 20 of the base plate 2 are connected to a first end 41, a second end 42, a first side, a second side and a central region 40 of the fabric. Similarly, the aforementioned regions of the fabric 4 are correspondingly connected to a first end 51, a second end 52, a first side, a second side and a central region 50 of the cover layer 5 by a further connection layer 3. The spacers 7 comprise a frame-shaped structure with dimensions corresponding to those of the connecting layer 3. The frame-shaped structure of the connecting layers 3 and the spacers 7 creates third cavities 700 between the base plate 2 and the fabric 4, or between the fabric 4 and the covering layer 5 in the areas of the through-holes of the connecting layers 3.

Figure 8:
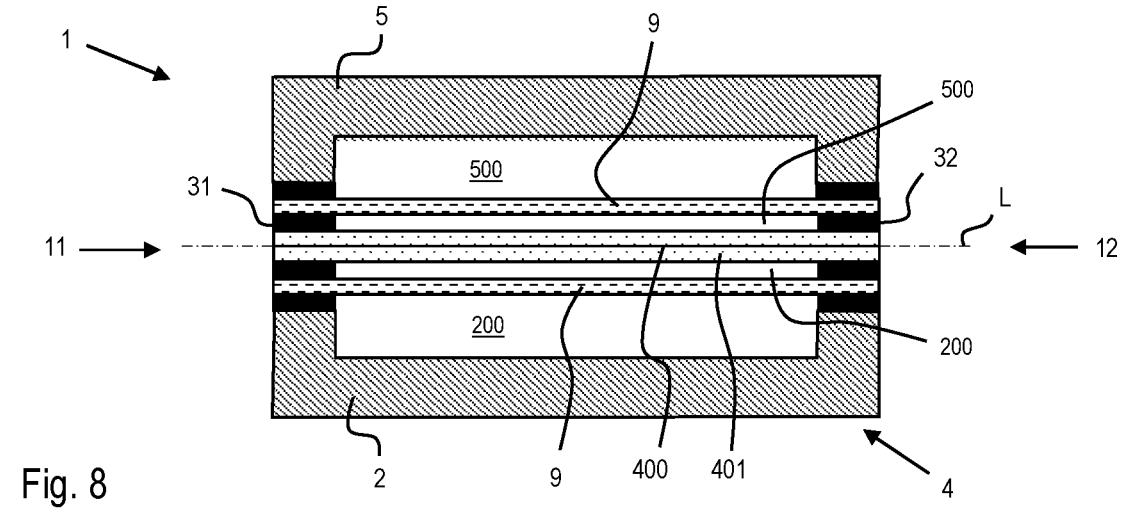
FIG. 8 a sectional view of a fourth embodiment of a fuse according to the invention before heating.

FIG. 8 shows a sectional view of a fourth embodiment of a fuse according to the invention before heating. This embodiment corresponds to that of FIGS. 1 to 3, but extinguishing layers 9 are arranged in the cavities 200, 500 by means of connecting layers 3. The quenching layers 9 are designed as closed surfaces which extend through the cavities 200,500 to the two ends 11,12 and the two sides of the fuse.

Figure 9:
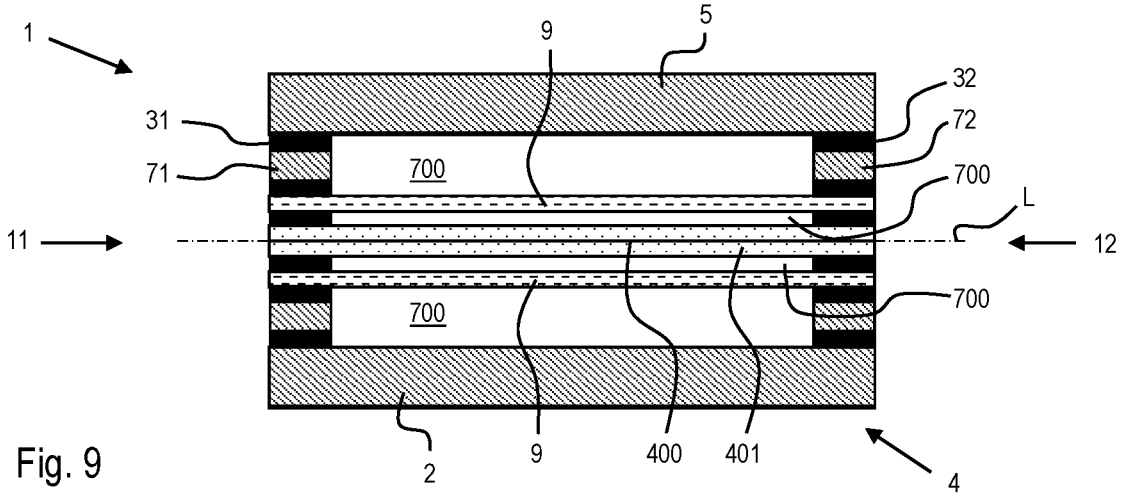
FIG. 9 a sectional view of a fifth embodiment of a fuse according to the invention before heating.

FIG. 9 shows a sectional view of a fifth embodiment of a fuse according to the invention before heating. This embodiment corresponds to that of FIGS. 4 to 6, but extinguishing layers 9 are arranged in the cavities 700 by means of connecting layers 3, the extinguishing layers 9 extending laterally and in the longitudinal direction to the periphery of the fuse 1.

Figure 10:
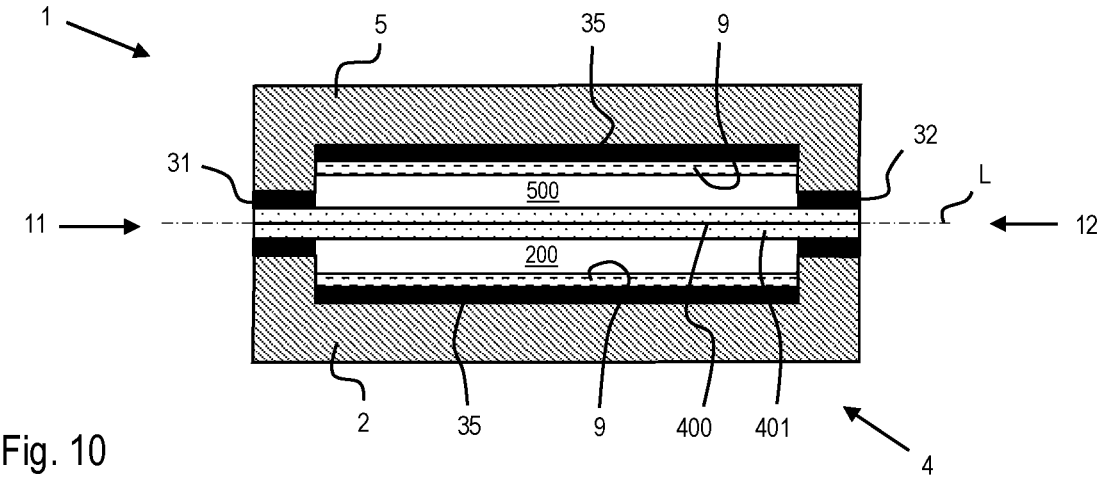
FIG. 10 a sectional view of a sixth embodiment of a fuse according to the invention before heating.
Figure 11:
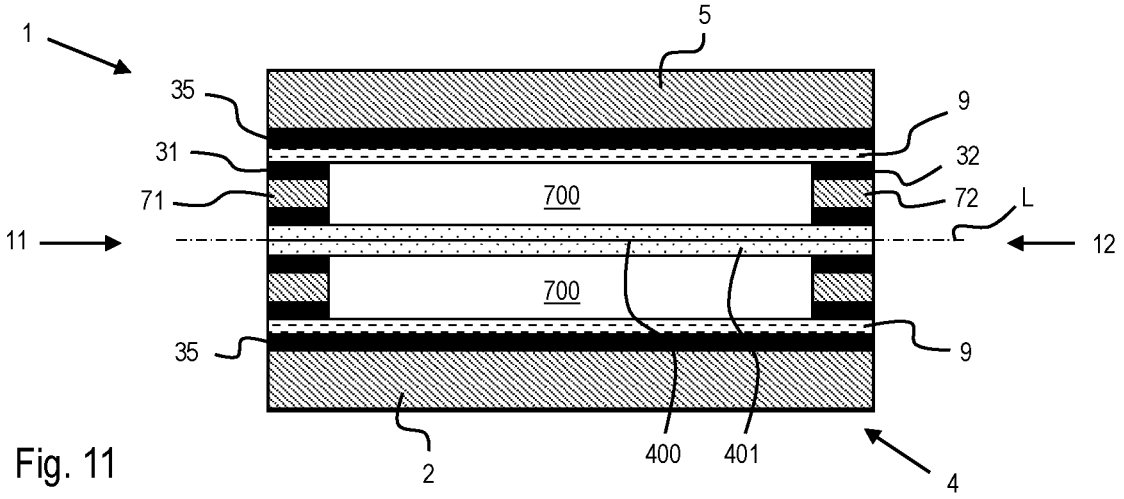
FIG. 11 a sectional view of a seventh embodiment of a fuse according to the invention before heating.

FIG. 10 shows a sectional view of a sixth embodiment of a fuse according to the invention before heating and FIG. 11 shows a corresponding sixth embodiment. These embodiments correspond to those of FIGS. 9 and 10, but the extinguishing layers 9 are connected to the base plate 2, or to the cover layer 5, by closed-surfaced connecting layers 35. In the embodiment of FIG. 10, the extinguishing layer 9 extends over the entire surface of the recess of the base plate 2 or the cover layer 5 facing the fabric 4. In the embodiment of FIG. 11, the extinguishing layer 9 extends from the first end 11 of the fuse 1 to its second end 12 over the entire surface of the base plate 2 or the cover layer 5 facing the fabric 4.

FIG. 12 shows a sectional view of a seventh embodiment of a fuse according to the invention before heating. Two fabrics 4 are arranged in a common cavity 700. The two fabrics 4 are separated from each other by a spacer 7. The fabrics 4 are separated from the base plate 2, or from the cover layer 5, by spacers 7 on the sides facing outwards, or upwards and downwards. The base plate 2, the spacers 7, the fabrics 4 and the cover layer 5 are connected to each other by frame-shaped connecting layers 3. Of course, two fabrics separated from each other by a spacer can also be arranged between a base plate and a cover layer, as shown for example in FIG. 10.

Figure 13:
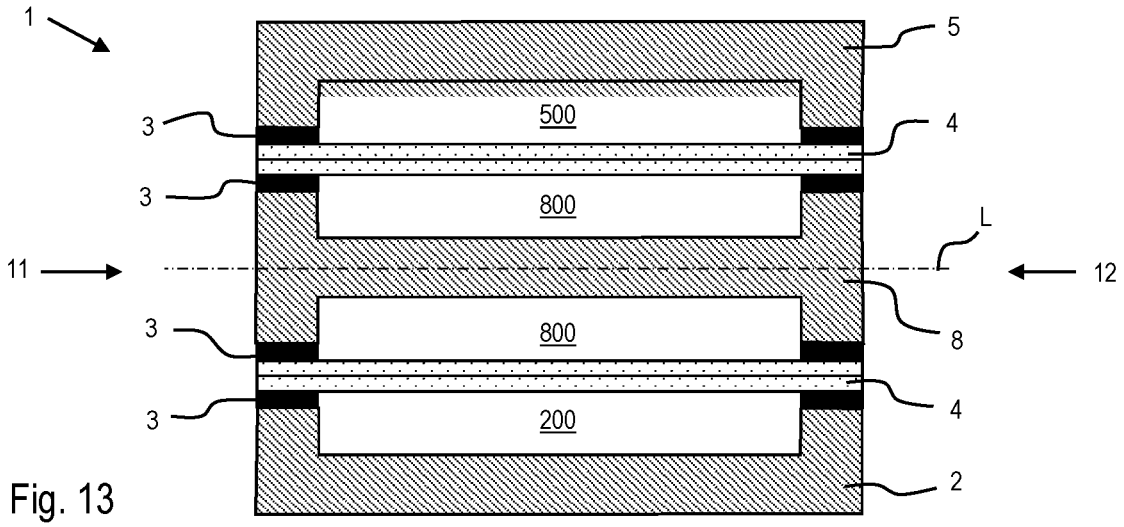
FIG. 13 a sectional view of a ninth embodiment of a fuse according to the invention before heating.

FIG. 13 shows a sectional view of an eighth embodiment of a fuse according to the invention before heating. Two essentially flat fabrics 4 are arranged in layers between the base plate 2 and the cover layer 5. A printed circuit board is provided as an intermediate layer 8 between the two fabrics 4. In the intermediate layer 8, recesses are formed at a distance from the edge regions of the upper and lower surfaces of the intermediate layer 8, which in the assembled state delimit a fourth cavity 800. The individual layers are connected to each other by connecting layers 3.

Figure 14:
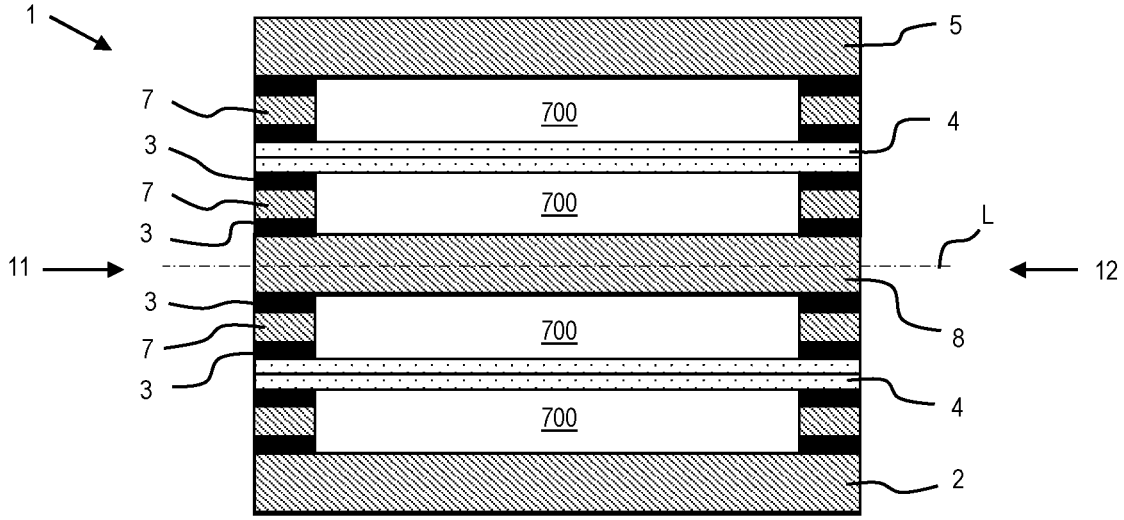
FIG. 14 a sectional view of a tenth embodiment of a fuse according to the invention before heating.
Figure 15:
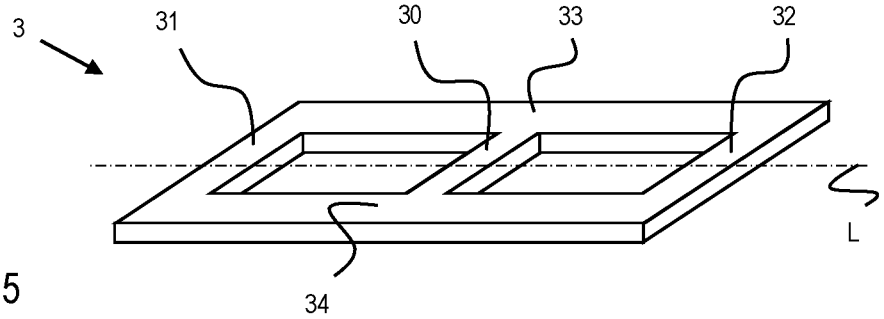
FIG. 15 a perspective view of a bonding layer.

FIG. 14 shows a sectional view of a sixth embodiment of a fuse according to the invention before heating. In contrast to the embodiment in FIG. 13, the base plate 2, the cover layer 5 and the intermediate layer 8 do not have any recesses. The cavities 700 are formed by the corresponding spacers 7, which are arranged between the base plate 2 and the fabric 4, the fabric 4 and the intermediate layer 8 and the fabric 4 and the cover layer 5 by means of corresponding connecting layers 3.

Figure 16A:
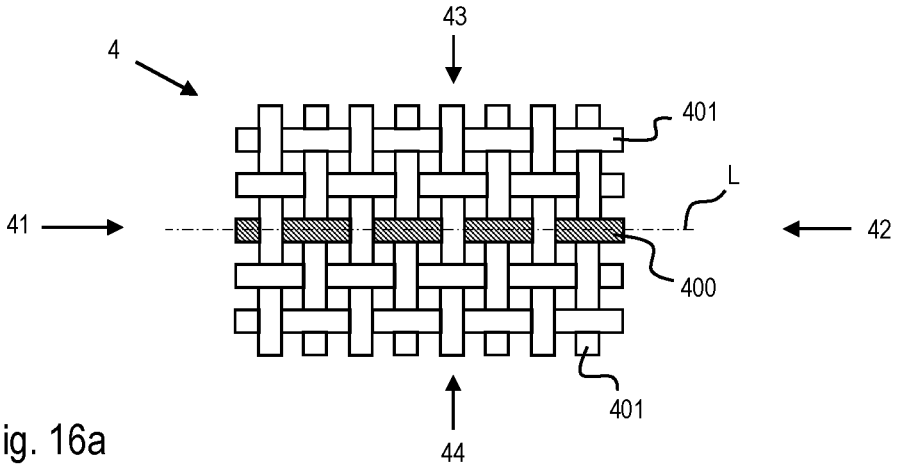
FIGS. 16*a-f* fabric embodiments.

FIG. 16*a* shows a first embodiment of a fabric 4, with an electrically conductive first fiber 400 extending along the longitudinal axis L and with non-conductive fibers 401 extending transversely to the longitudinal axis L and parallel thereto.

Figure 16B:
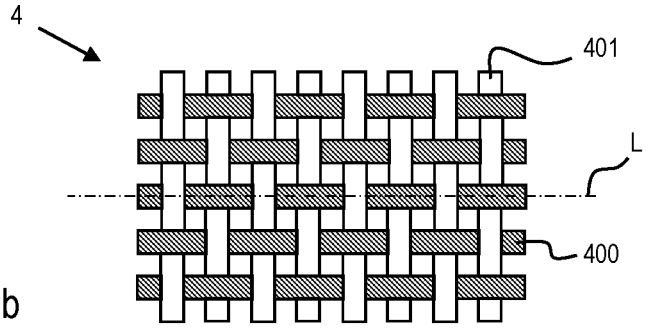

FIG. 16*b* shows a second embodiment of a fabric 4, with electrically conductive first fibers 400 extending along the longitudinal axis L and with non-conductive fibers 401 extending transversely to the longitudinal axis L.

Figure 16C:
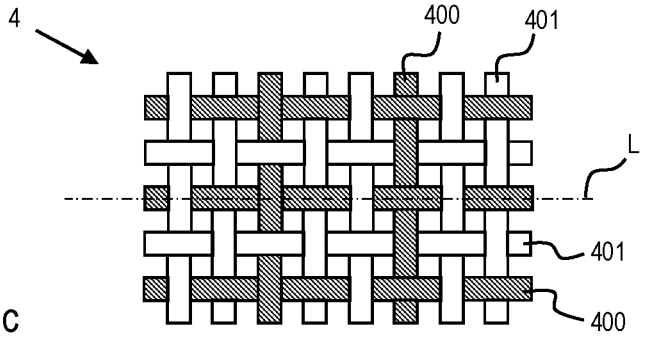

FIG. 16*c* shows a third embodiment of a fabric 4. The fabric 4 comprises a plurality of first fibers 400 extending along and transverse to the longitudinal axis L and second fibers 401 extending along and transverse to the longitudinal axis.

Figure 16D:
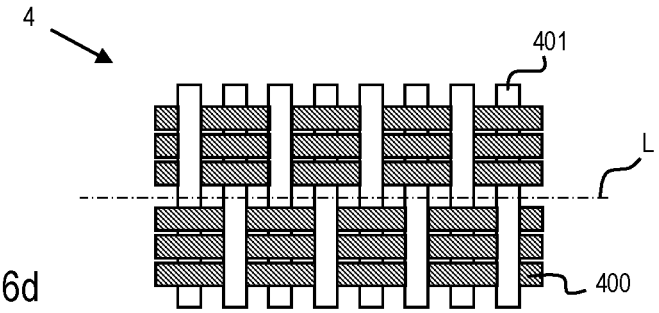

FIG. 16*d* shows a fourth embodiment of a fabric 4, wherein bundles of first fibers 400 are interwoven with individual second fibers 401.

Figure 16E:
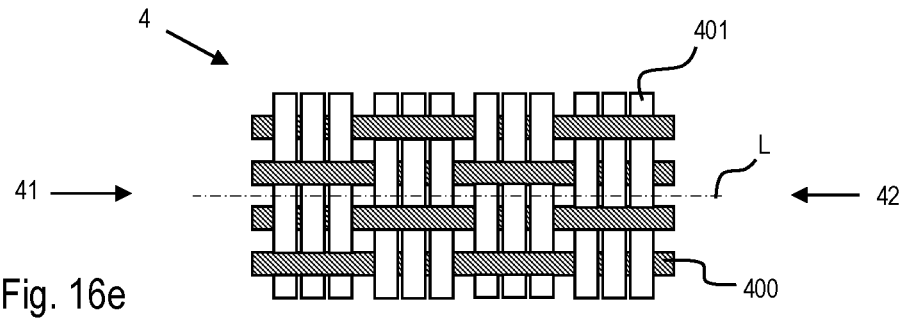

FIG. 16*e* shows a fifth embodiment of a fabric 4, wherein individual first fibers 400 are interwoven with bundles of second fibers 401.

Figure 16F:
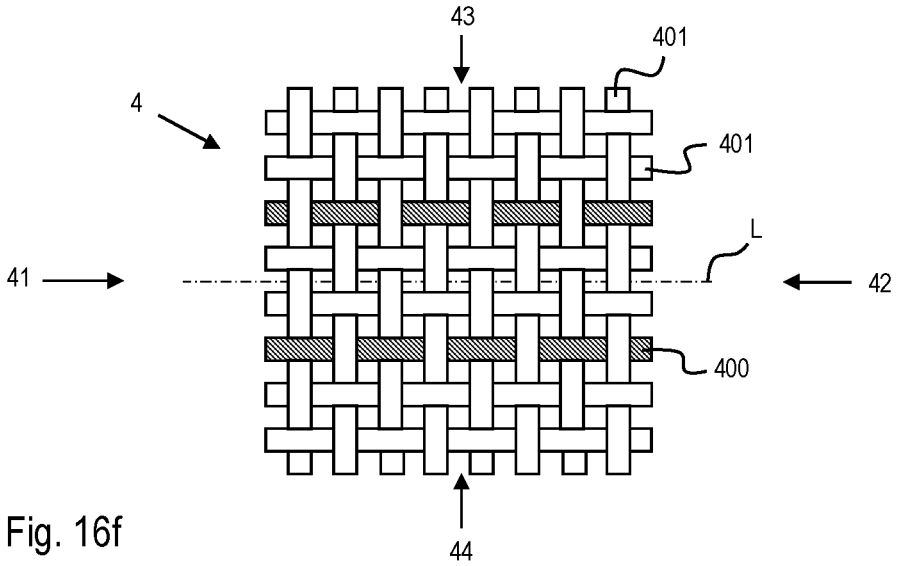

FIG. 16*f* shows a sixth embodiment of a fabric, wherein a plurality of second fibers 401 are interwoven between individual first fibers 400 extending along the longitudinal axis L from the first end 41 to the second end 42 of the fabric 4. The distance between the two conductive first fibers 400 can thus be adjusted very precisely. The more non-conductive second fibers 401 are arranged between two adjacent conductive fibers 400, the greater their spacing. In the area of the first side 43 and the second side 44 of the fabric 4 only non-conductive fibers 401 are provided, which is why the two lateral areas of the fabric 4 are non-conductive.

Figure 17A:
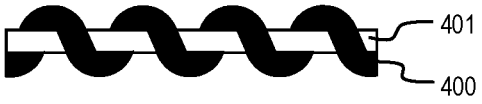
FIG. 17*a-b* wound conductive first fibers.
Figure 17B:
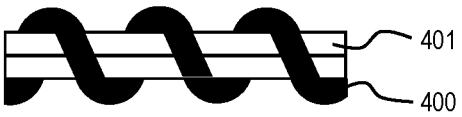

FIG. 17*a* shows a conductive first fiber 400 wound helically around a non-conductive second fiber 401 and FIG.

17*b* shows a first fiber 400 wound around a bundle of second fibers 401. Such wound first fibers 400 can be used in the previously described fabrics.

| REFERENCE SIGNS LIST | |
|---|---|
| 1 | fuse |
| 11 | first end |
| 12 | second end |
| 13 | first side |
| 14 | second side |
| 2 | base plate |
| 20 | middle section |
| 21 | first end |
| 22 | second end |
| 23 | first side |
| 24 | second side |
| 200 | cavity |
| 3 | connecting layer |
| 30 | web |
| 31 | first end |
| 32 | second end |
| 33 | first side |
| 34 | second side |
| 35 | Bonding layer |
| 4 | melt element/fabric |
| 40 | middle section |
| 41 | first end |
| 42 | second end |
| 43 | first side |
| 44 | second side |
| 400 | first fibers |
| 401 | second fibers |
| 402 | melted second fibers |
| 5 | top layer |
| 50 | middle section |
| 51 | first end |
| 52 | second end |
| 53 | first side |
| 54 | second side |
| 500 | cavity |
| 6 | contact element |
| 7 | spacer |
| 70 | web |
| 71 | first end |
| 72 | second end |
| 700 | cavity |
| 8 | intermediate layer |
| 800 | cavity |
| 9 | extinguishing layer |
| L | Longitudinal axis |

The invention claimed is:

1. A method of manufacturing a fuse extending from a first end along a longitudinal axis to a second end comprising the steps of:

providing a base plate;

stacking an at least partially conductive fabric over the base plate;

stacking a cover layer over the fabric;

providing a bonding layer between the base plate and the fabric and between the fabric and the cover layer, at least in respective edge regions of the base plate, fabric and cover layer;

wherein on both sides of the fabric, adjoining the fabric, at least one cavity is provided between the respective edge regions, wherein the fabric comprises at least one first fiber which is electrically conductive, and which extends along the longitudinal axis from the first end of the fuse to the second end of the fuse and comprises second fibers which are non-conductive and which extend at least transversely to the longitudinal axis (L), wherein the at least one first fiber has a higher melting temperature than the second fibers, heating the stacked elements to a temperature which is below the melting temperature of the at least one first fiber and which is above the melting temperature of the second fibers;

maintaining the temperature for a period of time;

whereby the second fibers melt at least in the region of the at least one first fiber, thereby at least partially releasing the at least one first fiber in the region of the cavities; and cooling the stacked elements to room temperature.

2. The method according to claim 1, wherein the base plate (2) comprises a printed circuit board.

3. The method according to claim 1, comprising arranging electrical contact elements at the two ends of the fuse, wherein the electrical contact elements are electrically conductively connected to the at least one first fiber.

4. The method according to claim 3, wherein the contact elements extend over the entire surface of the respective end of the fuse.

5. The method according to claim 1, wherein the at least one cavity includes at least one first cavity is formed in the base plate, between the edge regions of the base plate, and at least one second cavity formed in the cover layer, between the edge regions of the cover layer.

6. The method according to claim 1, further comprising arranging at least one frame-shaped spacer between the base plate and the fabric and/or between the fabric and the cover layer, wherein at least one third cavity is formed between edge regions of the spacer.

7. The method according to claim 6, further comprising arranging an extinguishing layer on one or both sides of the fabric by means of a bonding layer in a corresponding cavity of the at least one cavity.

8. The method according to claim 7, wherein the base plate, the cover layer and the extinguishing layer are formed as closed surfaces.

9. The method according to claim 8, wherein each bonding layer comprises a closed circumferential frame and/or wherein further bonding layers are provided to form a closed circumferential frame.

10. The method according to claim 9, wherein each bonding layer comprises at least one web extending transversely to the longitudinal axis from one side of the frame to an opposite side of the frame and wherein the at least one spacer comprises at least one web extending transversely to the longitudinal axis from one side of the frame to an opposite side of the frame.

11. The method according to claim 6, wherein the base plate, the bonding layer, the fabric, the at least one spacer and the cover layer are substantially rectangular and comprise two opposite ends and two opposite sides.

12. The method according to claim 1, comprising arranging two or more fabrics, wherein between two adjacent fabrics an intermediate layer is provided, which is connected to the fabrics by bonding layers or which is connected to the fabrics by bonding layers and spacers.

13. The method according to claim 12, wherein at least a fourth cavity is formed in the intermediate layer, between edge regions of the intermediate layer.

14. The method according to claim 1, wherein the fabric comprises first fibers extending transversely to the longitudinal axis.

15. The method according to claim 14, wherein the fabric comprises second fibers extending along the longitudinal axis.

16. The method according to claim 1, wherein the fabric comprises second fibers having a first melting temperature and second fibers having a second melting temperature different from the first melting temperature.

17. The method according to claim 1, wherein the fabric includes a plurality of first fibers which are at least partially combined and/or wherein the fabric includes a plurality of second fibers which are at least partially combined.

18. The method according to claim 1, wherein the fabric comprises only second fibers at least in the region of its two sides.

19. The method according to claim 1, wherein a plurality of the first fibers are provided, and the first fibers and/or the second fibers have different diameters.

20. The method according to claim 1, wherein the at least one first fiber has a fully conductive cross-section, or wherein the at least one first fiber comprises a conductive coating or a conductive core.

21. The method according to claim 1, wherein at least one first fiber is spirally wound around a second fiber or around a bundle of second fibers.

22. A fuse manufactured by the method according to claim 1 comprising the base plate, the at least partially conductive fabric and the cover layer, which are interconnected by the bonding layers at least in the respective edge regions, wherein the fabric comprises the at least one first fiber which is electrically conductive and which extends along the longitudinal axis from the first end of the fuse to the second end of the fuse and comprises the second fibers which are non-conductive, wherein the at least one first fiber has a higher melting temperature than the second fibers.

* * * * *